US008181295B1

(12) United States Patent
Mallinger

(10) Patent No.: US 8,181,295 B1
(45) Date of Patent: May 22, 2012

(54) ADJUSTABLE AIR MATTRESS DEVICE

(76) Inventor: Michael R. Mallinger, Olympia, WA (US)

( * ) Notice: Subject to any disclaimer, the term of this patent is extended or adjusted under 35 U.S.C. 154(b) by 288 days.

(21) Appl. No.: 12/639,741

(22) Filed: Dec. 16, 2009

(51) Int. Cl.
*A47C 27/10* (2006.01)

(52) U.S. Cl. ..... 5/710; 5/706; 5/733; 5/734; 5/713

(58) Field of Classification Search ..... 5/731, 733–735, 5/615, 715, 706, 710, 713
See application file for complete search history.

(56) References Cited

U.S. PATENT DOCUMENTS

| | | | | |
|---|---|---|---|---|
| 4,685,163 | A * | 8/1987 | Quillen et al. | 5/710 |
| 4,941,221 | A * | 7/1990 | Kanzler | 5/615 |
| 5,553,339 | A | 9/1996 | Thomas | |
| 5,577,278 | A * | 11/1996 | Barker et al. | 5/615 |
| 6,047,423 | A | 4/2000 | Larson | |
| 6,463,610 | B1 | 10/2002 | Shulte et al. | |
| 6,848,137 | B1 * | 2/2005 | Barnes | 5/710 |
| 7,127,764 | B1 | 10/2006 | Harding et al. | |
| 7,152,264 | B2 * | 12/2006 | Boyd | 5/706 |
| D551,484 | S | 9/2007 | Kasatshko et al. | |
| 7,360,266 | B2 * | 4/2008 | Kasatshko | 5/722 |
| 2006/0174416 | A1 | 8/2006 | Wu | |
| 2006/0200911 | A1 | 9/2006 | Hsueh | |

* cited by examiner

*Primary Examiner* — Michael Trettel

(57) ABSTRACT

An adjustable air mattress device comprising a main air mattress component having an inflatable inner cavity; a first torso elevation component disposed on a top surface of the main air mattress component at a front end having art inflatable inner cavity; a second torso elevation component disposed on a top surface of the first torso elevation component having an inflatable inner cavity; a first leg elevation component disposed on the top surface of the main air mattress component at a back end having an inflatable inner cavity; and a second leg elevation component disposed on a top surface of the first leg elevation component having an inflatable inner cavity; wherein the user can independently inflate the main air mattress component, the first torso elevation component, the second torso elevation component, the first leg elevation component, the second leg elevation component, or a combination thereof.

18 Claims, 3 Drawing Sheets

ADJUSTABLE AIR MATTRESS DEVICE

FIELD OF THE INVENTION

The present invention is directed to an air mattress, more particularly to an air mattress comprising multiple additional compartments that can be inflated to adjust the overall shape of the air mattress, for example to raise a user's head and shoulders and/or legs.

BACKGROUND OF THE INVENTION

Air mattresses and the like are known in the prior art. These bedding devices are commonly used as additional beds in a variety of different situations. The present invention features an air mattress that comprises a plurality of additional compartments that allows the overall shape of the air mattress to be adjusted according to the user's wishes or needs. For example, a user may wish to raise his/her head and torso for added comfort. Or, in some embodiments, a user may wish to raise his/her legs (or a combination of his/her legs and torso and head).

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
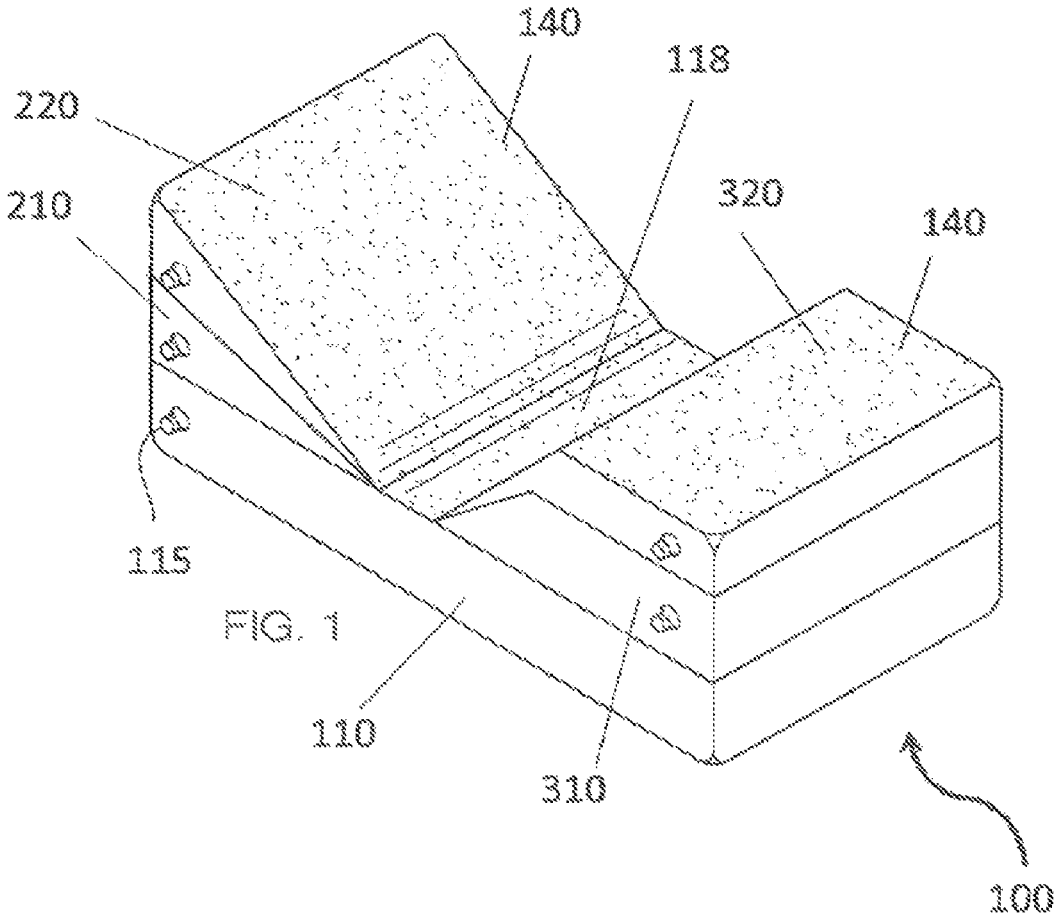
FIG. 1 is a first perspective view of the adjustable air mattress device of the present invention.
Figure 2:
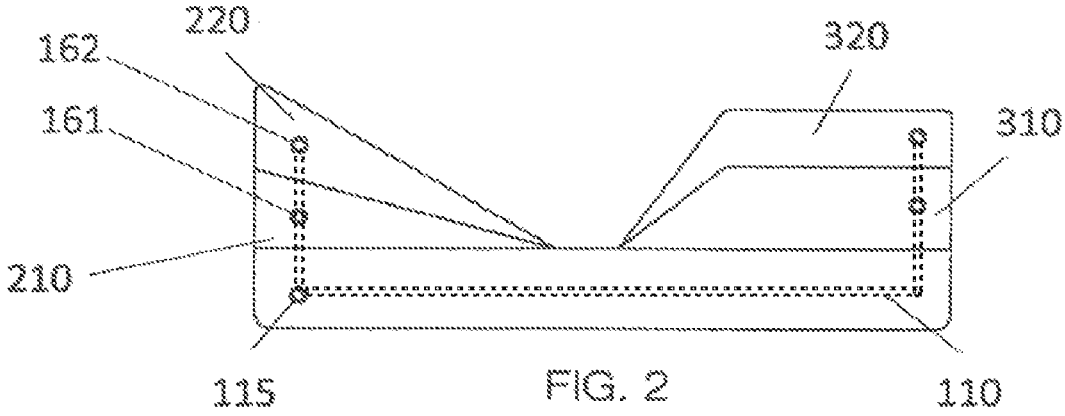
FIG. 2 is a side view of the adjustable air mattress device of FIG. 1.
Figure 3:
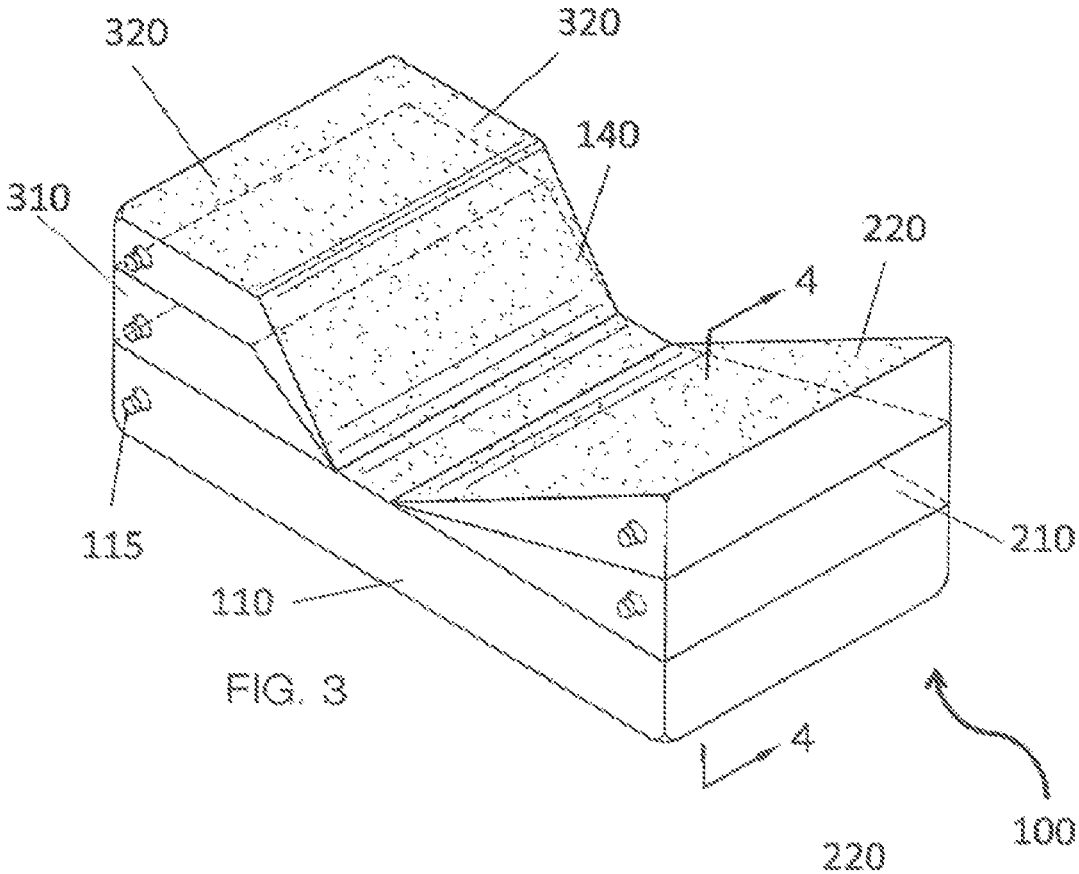
FIG. 3 is a second perspective view of the adjustable air mattress device of FIG. 1.
Figure 4:
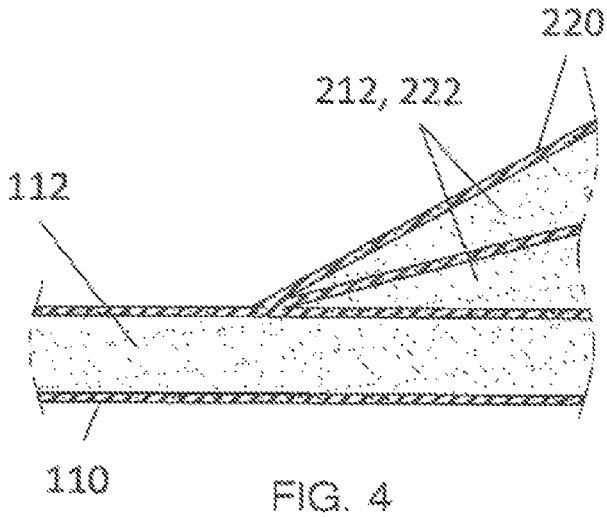
FIG. 4 is a side cross sectional view of the adjustable air mattress device of FIG. 1.
Figure 5:
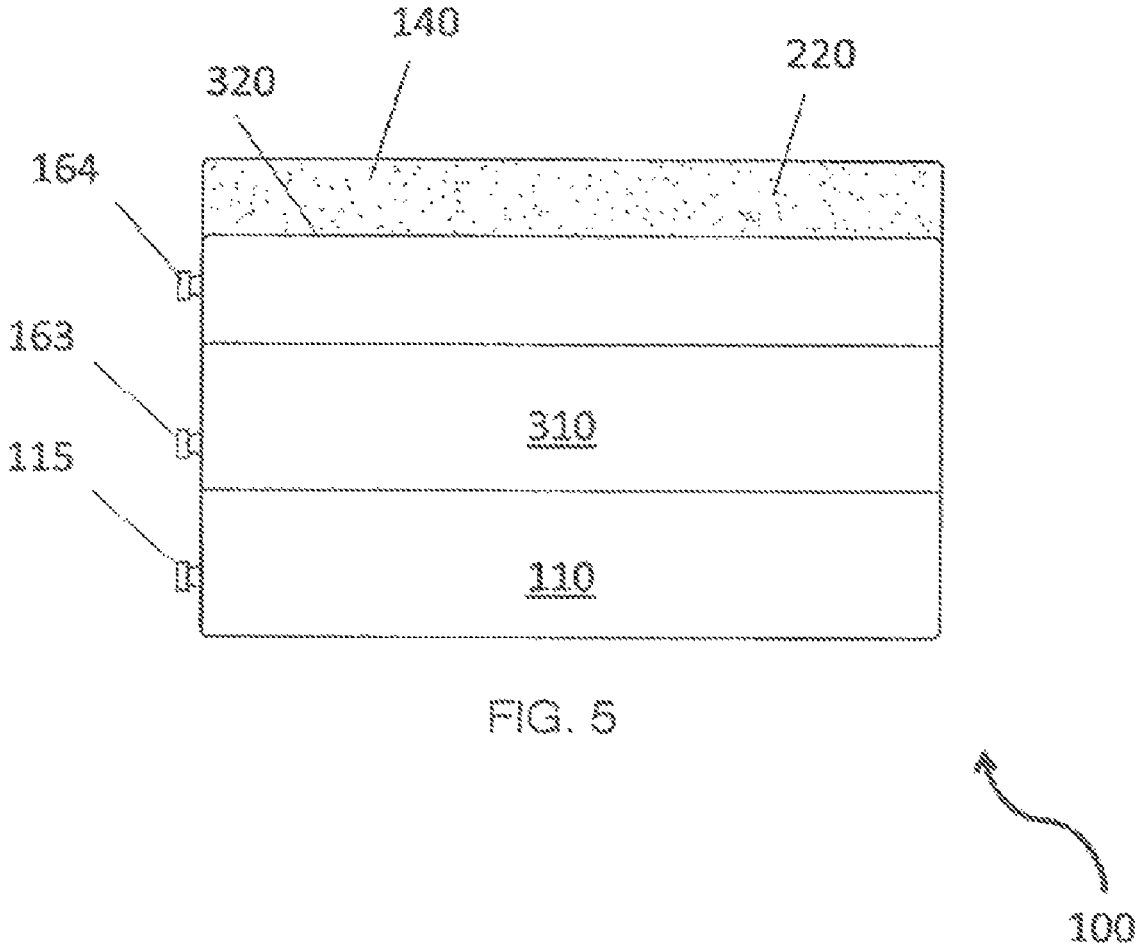
FIG. 5 is a back view of the adjustable air mattress device of FIG. 1.

Referring now to FIG. 1, FIG. 2, FIG. 3, FIG. 4, and FIG. 5, the present invention features an adjustable air mattress device 100 that provides a user a means of adjusting the overall shape of the air mattress device 100. For example, a user can inflate one or more compartments to raise or lower his torso and/or legs for support. In this manner, the air mattress device 100 can mimic a hospital bed. Without wishing to limit the present invention to any theory or mechanism, it is believed that the air mattress device 100 of the present invention is advantageous because it can help provide comfort to individuals suffering from conditions such as pain (e.g., back pain), hernias, asthma, the like, or a combination thereof. The air mattress device 100 can be used in a variety of settings, for example at home, on a camping trip, a road trip, and/or a time when an extra bed is needed.

The air mattress device 100 comprises a main air mattress component 110. The main air mattress component 110 is similar to standard air mattresses. For example, the main air mattress component 110 is generally flat and generally rectangular having a first side, a second side, a front end, a back end, a top surface, and a bottom surface. The main air mattress component 110 has an inner cavity 112 that is inflatable, for example via a main valve 115 disposed in the main air mattress component 110.

Disposed on the top surface of the main air mattress component 110 at the front end is a first torso elevation component 210. The first torso elevation component 210 may extend along the top surface of the main air mattress 110 from the front end to near the middle 118 of the main air mattress component 110. The first torso elevation component 210 may be constructed in a variety of shapes. For example, the first torso elevation component 210 may be constructed in a shape having a cross section that is generally triangular, a generally trapezoidal, or any other regular or irregular polygon, the like, or a combination thereof. The first torso elevation component 210 has an inner cavity 212 that is inflatable, for example via a first valve 161 disposed in the first torso elevation component 210. As used herein, a "cross section" is referred to a cross section going straight down the mattress from the head of the mattress to the foot of the mattress.

Disposed on the top surface of (on all of or a portion of) the first torso elevation component 210 is a second torso elevation component 220. The second torso elevation component 220 may be constructed in a variety of shapes. For example, the second torso elevation component 220 may be constructed in a shape having a cross section that is generally triangular, a generally trapezoidal, or any other regular or irregular polygon, the like, or a combination thereof. The second torso elevation component 220 has an inner cavity 222 that is inflatable, for example via a second valve 162 disposed in the second torso elevation component 220.

In some embodiments, the user inflates the main air mattress component 110 in combination with the first torso elevation component 210. In some embodiments, the user inflates the main air mattress component 110 in combination with the second torso elevation component 220. In some embodiments, the user inflates the main air mattress component 110 in combination with the first torso elevation component 210 and the second torso elevation component 220. The user can inflate the components according to his/her preferences, for example a user can partially inflate or fully inflate one or all of the components.

Disposed on the top surface of the main air mattress component 110 at the back end is a first leg elevation component 310. The first leg elevation component 310 may extend along the top surface of the main air mattress 110 from the back end to near the middle 118 of the main air mattress component 110. The first leg elevation component 310 may be constructed in a variety of shapes. For example, the first leg elevation component 310 may be constructed in a shape having a cross section that is generally triangular, a generally trapezoidal, or any other regular or irregular polygon, the like, or a combination thereof. The first leg elevation component 310 has an inner cavity that is inflatable, for example via a third valve 163 disposed in the first leg elevation component 310.

Disposed on the top surface of (on all of or a portion of) the first leg elevation component 310 is a second leg elevation component 320. The second leg elevation component 320 may be constructed in a variety of shapes. For example, the second leg elevation component 320 may be constructed in a shape having a cross section that is generally triangular, a generally trapezoidal, or any other regular or irregular polygon, the like, or a combination thereof. The second leg elevation component 320 has an inner cavity that is inflatable, for example via a fourth valve 164 disposed in the second leg elevation component 320.

In some embodiments, the user inflates the main air mattress component 110 in combination with the first leg elevation component 310. In some embodiments, the user inflates the main air mattress component 110 in combination with the second leg elevation component 320. In some embodiments, the user inflates the main air mattress component 110 in combination with the first leg elevation component 310 and the second leg elevation component 320. The user can inflate the components according to his/her preferences, for example a user can partially inflate or fully inflate one or all of the components.

The air mattress device 100 of the present invention is not limited to the aforementioned number of elevation components. For example, the air mattress device 100 may comprise more than two torso elevation components and/or more than two leg elevation components.

The various components (e.g., first torso elevation component 210, second torso elevation component 220, first leg elevation component 310, second leg elevation component 320) provide a user the ability to independently adjust the elevation of his/her torso and/or legs to various levels, according to his/her wishes or needs.

The air mattress device 100 may be covered with a covering component 140. The covering component 140 may be permanently attached to the air mattress device 100 (e.g., atop the second torso elevation component 220, atop the second leg elevation component 320, etc.). In some embodiments, the covering component 140 is removably attachable to the air mattress device 100. In some embodiments, the covering component 140 is constructed from a velour material. The covering component 140 is not limited to velour, for example the covering component 140 may be constructed from a material comprising cotton, linen, silk, nylon, the like, or a combination thereof.

In some embodiments, the components of the air mattress device 100 may be inflated in a standard manner, for example via blowing into the valves 115, 161, 162, 163, 164. Alternatively, the user may use additional tools to inflate the air mattress device 100. Included with the mattress device 100 is a heavy-duty plastic inflation device, one end of the device adjustable to accommodate the variously-sized air exhaust ports of the majority of commercial hair dryers, the opposite end of the device to fit the standard inflation valve on the base of the adjustable air mattress 115. When inflating the air mattress, all chambers are filled using the main valve of the base chamber. All the upper chambers have an open/closed valve, and so may be inflated individually, as desired, while the main chamber is being filled. In some embodiments, the device 100 includes an inflation device (e.g., adapter component). In some embodiments, the inflation device (e.g., adapter component) that has a first end and a second end, the first end being for connecting to the air mattress device 100 and the second end being for connecting to an air-blowing device (e.g., a hair dryer). The air-blowing device is not limited to a hair dryer. The second end of the inflation device (e.g., adapter component) may be adjustable to accommodate various sizes of air-blowing devices (e.g., hair dryers). In some embodiments, the inflation device is constructed from a material comprising plastic (e.g., the adapter components are plastic tips).

The air mattress device 100 of the present invention may be constructed from a variety of materials and in a variety or sizes. For example, in some embodiments, the air mattress device 100 is constructed from materials used in standard air mattresses. In some embodiments, the air mattress device 100 is constructed from a material comprising plastic, rubber, textiles, the like, or a combination thereof.

In some embodiments, the air mattress device 100 of the present invention is between about 60 to 70 inches in length as measured from the front end to the back end of the main air mattress component 110. In some embodiments, the air mattress device 100 is between about 70 to 80 inches in length as measured from the front end to the back end of the main air mattress component 110. In some embodiments, the air mattress device 100 is more than about 80 inches in length.

In some embodiments, the air mattress device 100 is between about 24 to 36 inches in width as measured from the first side to the second side of the main air mattress component 110. In some embodiments, the air mattress device 100 is between about 36 to 42 inches in width as measured from the first side to the second side of the main air mattress component 110. In some embodiments, the air mattress device 100 is more than about 42 inches in width.

In some embodiments, the air mattress device 100 is between about 6 to 12 inches in height as measured from the bottom surface of the main air mattress component 110 to the highest point of the second torso elevation component 220. In some embodiments, the air mattress device 100 is between about 12 to 24 inches in height as measured from the bottom surface of the main air mattress component 110 to the highest point of the second torso elevation component 220. In some embodiments, the air mattress device 100 is between about 24 to 36 inches in height as measured from the bottom surface of the main air mattress component 110 to the highest point of the second torso elevation component 220. In some embodiments, the air mattress device 100 is more than about 36 inches in height as measured from the bottom surface of the main air mattress component 110 to the highest point of the second torso elevation component 220.

In some embodiments, the air mattress device 100 is between about 8 to 16 inches in height as measured from the bottom surface of the main air mattress component 110 to the highest point of the second torso elevation component 220.

As used herein, the term "about" refers to plus or minus 10% of the referenced number. For example, an embodiment wherein the air mattress device 100 is about 60 inches in length includes an air mattress device 100 that is between 54 and 66 inches in length.

The following the disclosures of the following U.S. patents are incorporated in their entirety by reference herein: U.S. Pat. No. 5,553,339; U.S. Pat. Application No. 2006/0200911; U.S. Pat. Application No. 2006/017.4416; U.S. Pat. No. 6,463,610; U.S. Pat. No. 6,047,423.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An adjustable air mattress device comprising:

(a) a main air mattress component having a main valve and an inflatable inner cavity;

(b) a first torso elevation component disposed on a top surface of the main air mattress component at a front end, wherein the first torso elevation component has a first valve and an inflatable inner cavity;

(c) a second torso elevation component disposed on a top surface of the first torso elevation component, wherein the second torso elevation component has a second valve and an inflatable inner cavity;

(d) a first leg elevation component disposed on the top surface of the main air mattress component at a back end, wherein the first leg elevation component has a third valve and an inflatable inner cavity; and (e) a second leg elevation component disposed on a top surface of the first leg elevation component, wherein the second leg elevation component has a fourth valve and an inflatable inner cavity;

wherein the user can independently inflate the main air mattress component, the first torso elevation component, the second torso elevation component, the first leg elevation component, the second leg elevation component, or a combination thereof;

wherein the user can simultaneously inflate the main air mattress component, the first torso elevation component, the second torso elevation component, the first leg elevation component, and the second leg elevation component or a combination thereof via the main valve of the base chamber;

wherein the first torso elevation component, the second torso elevation component, the first leg elevation component, and the second leg elevation component each comprises an open/closed valve disposed within for isolation of a corresponding inflatable inner cavity.

2. The air mattress device of claim 1, wherein the first torso elevation component extend along the top surface of the main air mattress from the front end to near a middle region of the main air mattress component.

3. The air mattress device of claim 1, wherein the first torso elevation component is constructed in a shape having across section that is generally triangular, a generally trapezoidal, a regular polygon, an irregular polygon, or a combination thereof.

4. The air mattress device of claim 1, wherein the second torso elevation component covers a portion of the top surface of the first torso elevation component.

5. The air mattress device of claim 1, wherein the second torso elevation component covers all of the top surface of the first torso elevation component.

6. The air mattress device of claim 1, wherein the second torso elevation component is constructed in a shape having a cross section that is generally triangular, a generally trapezoidal, a regular polygon, an irregular polygon, or a combination thereof.

7. The air mattress device of claim 1, wherein the first leg elevation component extends along the top surface of the main air mattress from the back end to near a middle region of the main air mattress component.

8. The air mattress device of claim 1, wherein the first leg elevation component is constructed in a shape having a cross section that is generally triangular, a generally trapezoidal, a regular polygon, an irregular polygon, or a combination thereof.

9. The air mattress device of claim 1, wherein the second leg elevation component covers a portion of the top surface of the first leg elevation component.

10. The air mattress device of claim 1, wherein the second leg elevation component covers all of the top surface of the first leg elevation component.

11. The air mattress device of claim 1, wherein the second leg elevation component is constructed in a shape having a cross section that is generally triangular, a generally trapezoidal, a regular polygon, an irregular polygon, or a combination thereof.

12. The air mattress device of claim 1, wherein the air mattress device is covered with a covering component.

13. The air mattress device of claim 12, wherein the covering component is permanently attached to the air mattress device.

14. The air mattress device of claim 12, wherein the covering component is removably attached to the air mattress device.

15. The air mattress device of claim 1, wherein the air mattress device is inflated by manually blowing into the valves.

16. The air mattress device of claim 1, wherein the air mattress device is inflated via an air-blowing device.

17. The air mattress device of claim 1 further comprising an inflation device.

18. The air mattress device of claim 17, wherein the inflation device has a first end and a second end, the first end being for connecting to the air mattress device and the second end being for connecting to an air-blowing device.

* * * * *